United States Patent [19]

Jäger

[11] 4,073,431

[45] Feb. 14, 1978

[54] SOLID JACKET WORM CENTRIFUGE WITH RPM DIFFERENTIAL VARIABLE COUPLING BETWEEN JACKET PART AND WORM PART

[75] Inventor: Ernst Adolf Jäger, Vilsbiburg, Germany

[73] Assignee: Flottweg-Werk Dr. Georg Bruckmayer GmbH & Co. KG, Germany

[21] Appl. No.: 743,077

[22] Filed: Nov. 18, 1976

[30] Foreign Application Priority Data

Nov. 18, 1975 Germany ..... 2551788

[51] Int. Cl.[2] ..... B04B 1/20; B04B 9/10

[52] U.S. Cl. ..... 233/7; 233/24

[58] Field of Search ..... 233/7, 19 R, 19 A, 20 R, 233/20 A, 23 R, 24, 27

[56] References Cited

U.S. PATENT DOCUMENTS

| | | | |
|---|---|---|---|
| 2,867,378 | 1/1959 | Harlow | 233/24 X |
| 3,126,337 | 3/1964 | Smith | 233/19 R |
| 3,494,542 | 2/1970 | Craig et al. | 233/7 |
| 3,734,399 | 5/1973 | Oas | 233/7 |
| 3,923,241 | 12/1975 | Cyphelly | 233/7 |
| 3,957,197 | 5/1976 | Sartory et al. | 233/19 R |

*Primary Examiner*—George H. Krizmanich

*Attorney, Agent, or Firm*—Craig & Antonelli

[57] ABSTRACT

A solid shell screw conveyor centrifuge which includes a screw rotating at a differential speed with respect to the shell. One of the shell and screw is connected to a first hydraulic motor as a main drive assembly and to the other of the shell and screw by way of a second hydraulic motor having pressure medium supplied thereto by way of a rotary transmission. The first hydraulic motor functions as a drive assembly for the shell and also is operable as a pump with a discharge from the pump being controlled by way of a valve arrangement. The valve arrangement is disposed in a conduit connecting the hydraulic motor with a pressure medium conduit supplying pressure medium to the rotary transmission of the second hydraulic motor.

18 Claims, 1 Drawing Figure

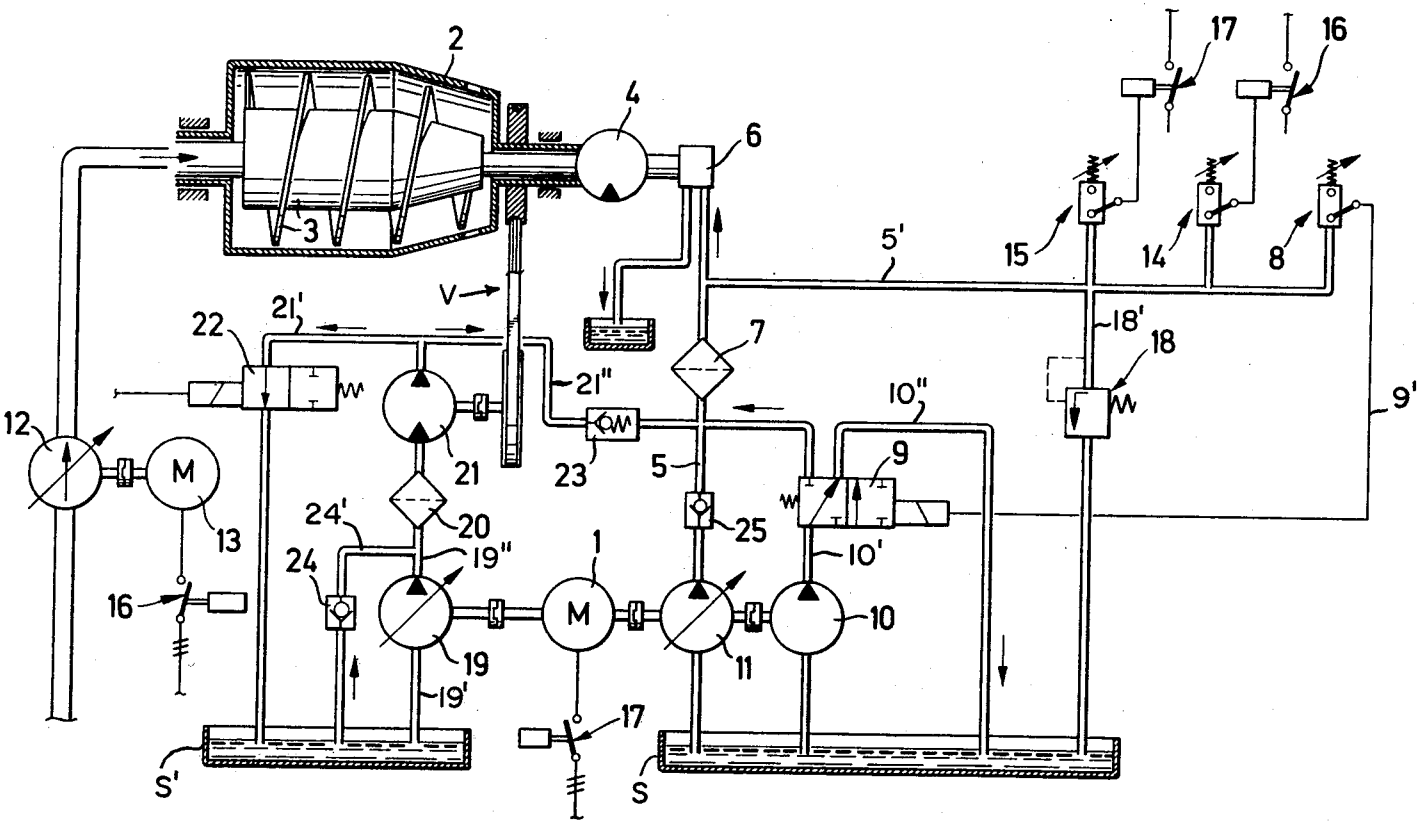
9'
16
8
17
14
18'
18
15
5'
10''
9
10'
10
6
7
25
11
4
5
S
21''
23
1
M
17
2
V
21
20
19''
19
19'
3
24'
24
21'
22
13
M
16
S'
12

SOLID JACKET WORM CENTRIFUGE WITH RPM DIFFERENTIAL VARIABLE COUPLING BETWEEN JACKET PART AND WORM PART

The present invention relates to a centrifuge and, more particularly, to a solid shell screw conveyor centrifuge which includes a screw part rotating at a differential speed with respect to the solid shell part. One of the shell and the screw is connected to a first hydraulic motor and serves as a main drive assembly with the other of the shell and screw being connected by way of a second hydraulic motor.

In one proposed solid-shell screw type conveyor centrifuge, described in Offenlegungsschrift No. 24 32284 and U.S. Pat. No. 3,923,241, the differential speed between the shell and screw are controlled manually. By virtue of this manual control, it is possible to adjust the differential speed so that such speed conforms to the consistency and separating conditions of the suspension to be processed in any given situation. A disadvantage of the manual control resides in the fact that, if a suspension is obtained with differing consistency, as is the case, for example, with sewage sludge, the operation of the centrifuge must be constantly monitored and a hydraulic motor arranged between the shell and screw must be controlled with respect to the amount and/or pressure of the pressure medium fed to the hydraulic motor.

While it is possible, for example, when the screw is subjected to an increased load, to effect the amount of pressure fluid supplied to the hydraulic motor manually, an increase in the load on the screw and/or an increase in the torque output of the screw results in a pressure increase in the hydraulic motor and the elements connected to the motor which carry the hydraulic fluid. This pressure increase results in an enlarged quantity of leakage fluid which, in turn, leads to a reduction in the differential speed between the screw and the shell.

Unfortunately, a reduction in the differential speed further causes an increase in the proportion of solids within the separating chamber of the centrifuge which means that a torque at the screw will be further increased. The resulting pressure increase further raises the amount of leakage fluid thereby further reducing the differential speed. Finally, this multiple feedback effect results in a clogging of the centrifuge because the differential speed between the shell and screw becomes too low.

Yet it is possible that the condition which is responsible for controlling the leakage of fluid and condition of the screw load may compensate each other in such a way that a stable operating condition is attained, this is extensively dependent upon the respective operating conditions and is predictable only in the rarest situations, if at all, when the operating point of the machine is reached and when its operating condition becomes stable. However, typically, the operation of the proposed machine must be monitored constantly and the quantity of the pressure fluid supplied to the machine must be manually controlled. Of course, the monitoring does not include use of devices which prevent the supply of effluent in the case of overload conditions and/or which shut off the entire system upon the occurrence of such an overload.

To insure continuous operating condition of the centrifuge when processing a suspension with a differing consistency, it is possible to provide differential speed and/or torque control means. By virtue of a provision of such means, the working efficiency of the centrifuge can be adjusted to an optimum without having to provide the heretofore necessary large safety margins in the torque and/or volume output of the centrifuge. In such situations, the desired value of the differential speed is governed by a value dimensioned according to a critical value related to the specific suspension being processed and, when this desired value is exceeded or when the actual value of the differential speed falls short of the desired value, the differential speed between the shell and screw may be controlled so that the desired value is once again restored.

The determination of the critical values with respect to given suspensions can be effected by suitable measuring operations or it is also possible to have the desired value of the differential speed fixedly predetermined by virtue of the nature of the suspension being processed.

A number of possibilities exist to determine the actual value of the differential speed outside of the centrifuge. For example, measurements can be made of the volume of suspension fed to the centrifuge and/or the volume of the separated solid matter. On the basis of such measurements, conclusions can be reached as to the relationships of the suspension in the separation chamber of the centrifuge and/or the load on the screw.

Another possibility of determining the differential speed is by monitoring the prevailing condition or pressure of the pressure medium in a supply conduit to the second hydraulic motor with the prevailing condition or pressure being indicative of the actual value of the differential speed. What is involved in such a situation is a determination of the amount of pressure medium supplied per unit time or merely a determination of the actual pressure in the delivery conduit.

To control the differential speed between the screw and shell, an ideal value-actual value comparator arrangement may be provided for determining and providing a control signal which is fed to a control system to either increase or decrease the differential speed to maintain the ideal value throughout the entire processing of the suspension. The ideal value-actual value comparator can be constructed in a number of known ways with the structural form of the comparator being based primarily upon the nature of the actual value which is provided for the type of control signal to be rendered by the comparator.

If the prevailing pressure in a supply conduit is to be monitored and viewed as the actual value which is to be compared with a given ideal value, the comparator may be provided with a spring and piston adapted to be displaced against the spring in response to a sensing of the pressure in the supply conduit. In such a construction, the specific force of the spring would represent the ideal value with the movement of the piston determining the point at which the actual value corresponds to the ideal value, that is, when the pressure in the supply conduit acting upon the piston corresponds to the specific force of the spring. Upon the occurrence of the ideal value, the comparator may provide a signal to control a hydraulic valve or choke or, for example, the signal may alter the resistance in an electrical control system.

While a centrifuge provided with differential speed and/or torque control means eliminates the need for human monitoring and manual control of the differential speed between the shell and screw, no provisions are made in the proposed centrifuge system to protect the elements of the rotary transmission in the event of a failure in the supply of a pressure medium to the second hydraulic motor.

The aim of the present invention essentially resides in providing a centrifuge system wherein an adequate supply of pressure medium to the rotary transmission is assured in all operating conditions of a centrifuge system.

In the rotary transmission provided for the delivery of a pressure medium to the second hydraulic motor arranged between the screw and shell, rotary passages are provided which assure the connection between the stationary pressure medium conduits and the circulating hydraulic motor. The rotary passages are high-quality structural elements insofar as they are supposed to allow for the least possible leakage of pressure medium. If an operating condition arises wherein the shell continues to turn with a simultaneous interruption of a supply of pressure medium to the second hydraulic motor, there would be no delivery of a pressure medium for the screw drive elements of the second hydraulic motor. The failure of a delivery of the pressure medium would dissolve in a lack of sufficient lubrication for the parts of the rotary transmission thereby leading to a damaging of such parts.

In the operation of a centrifuge system there are two operating stages which must be distinguished. First, if there was an intentional shut off of the centrifuge system such shut off would shut off the supply of pressure medium to the drive of the shell thereby stopping the rotation of the shell. The hydraulic motor arranged between the screw and the shell would be fed as before and the screw would turn with the same differential speed with respect to the shell. Consequently, the screw would clear the separating chamber of the centrifuge during a normal slow down or run down of the centrifuge system due to an intentional shut down of such system. Additionally, the screw drive is ordinarly only switched off toward the end or after a complete stopping of the shell.

However, if a stoppage of a centrifuge system is unintenional due to any number of causes as, for example, an overload, a failure of the safety devices, a failure in the supply of the pressure medium or the like, the drive to the first hydraulic motor would be the first to be interrupted. In such a situation several possible conditions may exist.

First, the drive for the shell may continue to function while the drive for the screw stops. If the two drives are independent of each other, the hydraulic motor arranged between the shell and the screw will no longer be supplied with a pressure medium. Therefore, in a very short time, the lubricating that is insured by an adequate feed of the pressure medium to the rotary transmission and the hydraulic motor would no longer exist and the rotary passages in the rotary transmission that effect a supply of pressure medium to the hydraulic motor will be damaged. One possibility of avoiding any damage if separate drives are provided would be a switching in of an emergency pressure medium supplying system so as to at least insure an adequate lubrication of the rotary transmission and the hydraulic motor. However, as can be appreciated, the provision of a separate pressure medium supply arrangement can considerably increase the total cost of the centrifuge system.

However, even if a separate pressure medium supply arrangement were provided for at least insuring lubrication of the rotary transmission and hydraulic motor, such supply would be insufficient to drive the screw and, consequently, the screw would no longer turn with respect to the shell thereby resulting in the separating chamber becoming clogged or jammed. Dependent upon the specific properties of the suspension being processed, such a clogging or jamming can be very expension since disassembly of the centrifuge system may be required to unclog the separating chamber of the centrifuge. However, a disassembly of the centrifuge would cause a considerable down time in the centrifuge system thereby resulting in an interrupted delivery of the separated materials to other production stages downstream of the centrifuge system. Any considerable down time of the centrifuge and interruption in the delivery of the separated materials can cause considerable damage in a continuous process especially, for example, when the centrifuge system is used in the field of chemistry.

If a common drive for the screw and shell is provided, for example, an electric drive motor connected by way of a mechanical coupling between the shell and a pump for the hydraulic motor of the screw, if such electric drive motor fails, the shell would continue to be driven by virtue of kinetic energy. This movement of the shell would be transmitted to the pump of the hydraulic motor for the screw which would be supplied with decreasing amounts of pressure medium by virtue of the decreasing in the revolutions of the shell. Lubrication for the rotary transmission would be insured since the differential speed between the screw and the shell would continuously decrease until the shell stopped rotation. In this situation, the delivery of the suspension would be interrupted and any solid material remaining in the shell would be withdrawn by virtue of the continual rotation of the shell and screw.

Consequently, for the usual case, a central drive for the hydraulic motor of the screw and the direct or indirect drive of the shell that occurs by way of a further hydraulic motor affords a pressure medium supply for the hydraulic motor of the screw and, also the rotary transmission which supply would be necessary for the gradual running down of the centrifuge after a cut off of the common drive motor. This would be the case whether the shut off of the centrifuge system was intentional or unintentional.

However, the situation may arise wherein, in spite of providing a common drive motor, the pressure medium supplied to the hydraulic motor of the screw is interrupted, for example, by virtue of a mechanical defect of a related pump drive, from defects in the pump element itself, or a leakage in the supply conduit to the hydraulic motor for the screw. In such a situation, the pressure of the pressure medium in the supply conduit for the hydraulic motor arranged between the screw and shell would drop. While slight fluctuations of pressure in the pressure medium can be tolerated if the suspension being processed has irregularities in its consistency, if the pressure drops below a fixed minimum value that is a function of the irregularities in the consistency and a fixed minimum value of the necessary lubrication for the rotary transmission, the drive motor shut off and the shell, running down, would drive the drive motor; however, by virtue of the fact that an insufficient supply of pressure medium exists in the supply conduit by virtue of the occurrence of the above-noted defects in the pump drive, pump element or pressure conduit, the continual rotation of the shell cannot insure an adequate pressure supply for the hydraulic motor of the screw. Consequently, a damaging of the rotary transmission and drive for the screw may occur. Additionally, a blocking or jamming of the screw inside the drum may result by virtue of the lack of a drive for the screw.

The underlying problems are solved in accordance with the present invention by providing an arrangement which insures an adequate supply of the pressure medium to the hydraulic motor disposed between the shell and screw by way of the rotary transmission in all situations as long as the shell continues to rotate.

In accordance with one feature of the present invention, the drive for the shell is constructed as a hydraulic motor which functions as a pump during the operation of the shell with a discharge from the pump being supplied by way of a connecting conduit with a pressure medium supply conduit for the rotary transmission and hydraulic motor for the screw drive.

By virtue of the construction of the present invention, it is insured that, with a drop of pressure in the pressure medium supply conduit for the hydraulic motor disposed between the screw and the shell below a specific predetermined value, the amount of pressure medium required for lubrication of the rotary transmission will nevertheless be supplied. Thus, after a cut off of the drive motor, either intentionally or unintentionally, the shell will continue to rotate thereby driving the hydraulic motor which, functioning as a pump, introduces a supply of a pressure medium into the conduit supplying the rotary transmission.

Additionally, by virtue of the present invention, the hydraulic motor arranged between the screw and the shell continues to turn whereby, advantageously, the centrifuge continues to operationally function until both the shell and screw come to a standstill thereby preventing an incomplete operation run off.

Since the hydraulic motor for the drive of the shell, when it functions as a pump, furnishes an output for the shell drive to feed the hydraulic motor for the screw drive, a corresponding braking moment is exerted on the shell whereby the shell slows down at a more rapid rate. To control the rate of slow down of the shell, in accordance with the present invention, a control arrangement is arranged between the pump discharge of the hydraulic motor for driving the shell and the supply conduit for supplying pressure medium to the hydraulic motor of the screw drive whereby it is possible to have a decreasing revolution of the break shell quickly taken through a critical rotational speed range.

In accordance with another advantageous feature of the present invention, the control arranged between the pump discharge and the pressure medium supply conduit is formed as a check valve which either has a fixed operating characteristic or is adjustable so as to be responsive to specific prevailing conditions in the centrifuge system.

An advantage in the braking of the shell in accordance with the present invention resides in the fact that any solid matter in the shell is flushed through to a discharge opening for the solid matter and/or to the other end of the shell whereby the shell is cleared of residue. This advantage is the result of the inertia of the shell and the corresponding existing speed differential with respect to the screw.

By virtue of the provision of a hydraulic motor for driving the screw and a hydraulic motor for driving the shell, not only is it insured that an emergency operation of the centrifuge can be effected by simple means but also it is possible to regulate the rotational speed of the shell.

Thus, if a braking of the shell is required for regulation of, for example, the differential speed between the shell and screw, due to the nature of the suspension being processed, the hydraulic motor for the shell then functions as a pump when driven by the shell. This regulation of the shell and screw drive is realized by merely providing a connecting conduit between the discharge of the pump and the supply conduit for the pressure medium to the rotary transmission for the hydraulic motor of the screw in which connecting conduit a control device as, for example, a check valve may be arranged.

Accordingly, it is an object of the present invention to provide a solid shell screw conveyor centrifuge system which avoids by simple means the aforementioned shortcomings and drawbacks encountered in the prior art.

Another object of the present invention resides in providing a solid shell screw conveyor centrifuge system which insures an adequate supply of a pressure medium to a hydraulic motor arranged between the shell and screw as long as the shell continues to rotate.

Still another object of the present invention resides in providing a solid shell screw conveyor centrifuge system which insures an adequate lubrication of the rotary transmission for the hydrualic drive motor of the screw thereby minimizing if not avoiding any damage to the transmission in the event of a failure of a pressure medium supplied to such transmission.

These and other objects, features and advantages of the present invention become more apparent from the following description when taken in connection with the accompanying drawing which shows, for the purposes of illustration only, one embodiment in accordance with the present invention, and wherein:

The single FIGURE is a schematic illustration of a solid shell screw centrifuge system in accordance with the present invention.

Referring now to the single FIGURE, according to this figure, a solid shell screw type centrifuge includes a shell 2 surrounding a helical screw 3 supported in the shell 2 in a conventional manner. A single drive motor 1 indirectly drives the centrifuge shell 2 as well as the screw 3 with the screw leading or trailing with respect to the shell 2 by a predetermined differential speed.

In operation, the solid matter in the suspension fed to the centrifuge is conveyed through the helix of the screw 3 and is transported by way of a drying zone to a discharge opening whereby the solid matter is first dried and subsequently discharged through the opening.

The screw 3 is drivingly connected with the shell 2 by way of a hydraulic motor 4 mounted on the drive shaft of the screw 3 with the screw rotating relative to the shell 2. The hydraulic motor 4 is coupled to the shell 2 through the housing or stator of the motor 4. The rotor of the hydraulic motor 4 moves relative to the stator or housing in dependence upon the amount of pressure medium supplied thereto by way of a pressure conduit 5.

A rotary transmission 6 is connected between the drive motor 4 and the conduit 5 for controlling the supply of pressure medium to the drive motor. The rotary transmission 6 is preferably of the type described in Swiss Pat. Nos. 526061 and/or 545933 corresponding to U.S. Pat. Nos. 3,685,842 and 3,767,213. The rotary transmission 6 insures that the pressure medium can flow without appreciable leakage losses from the fixed pressure conduit 5 to the hydraulic motor 4 and again return from the hydraulic motor 4.

As the quantity of pressure medium supplied to the hydraulic motor 4 increases by way of the supply of pressure medium through the pressure medium conduit 5, wherein a filter 7 is disposed, and by way of the rotary transmission 6, the differential speed of the screw 3 relative to the shell 2 increases. If the load on the screw 3, increased by any number of causes, requires a larger driving torque to maintain the prescribed differential speed, then the pressure within the conduit 5 is increased. This increase in pressure is introduced into an actual value-desired value comparator valve generally designated by the reference numeral 8 by way of a conduit 5' and, upon the actual pressure surpassing the pressure applied by way of a spring bias which corresponds to a preset desired value of the comparator valve 8, a multi-channel or multiple-way valve 9 is switched by way of a transmission line 9' between the comparator valve 8 and the valve 9, which line may, for example, be an electrical line.

The switching of the valve 9 connects a previously disconnected auxiliary pump 10 into a supply line 10' which feeds the pressure medium from a supply or collecting tank S to the pressure conduit 5. Thus, if the actual pressure within the conduit 5 exceeds a prescribed value, as determined by the comparator valve 8, then the conduit 5 is supplied with a combined pressure medium from the auxiliary pump 10 and primary pump 11 in view of the action of the valve 9.

In a normal operation, when the valve 9 is connected as shown in the drawing, so that the output of the pump 10 is returned by way of a conduit 10" to the pressure medium supply or collecting tank S, the pressure medium supplied to the hydraulic motor 4 is provided only by way of the primary pump 11 which, incidentally, may be controllable so as to supply a valuable amount of fluid pressure to the conduit 5 to control the differential speed between the shell 2 and the screw 3.

In place of a controllable primary pump 11, a nonadjustable or fixed fluid pressure pump may be used and a pressure and/or amount of fluid within the conduit 5 may be controlled by way of a bypass valve arrangement. The bypass valve arrangement can be interconnected in a manner similar to the pump 10; however, incidentally variable control of the pressure of the pressure medium is achievable in this connection. Of course, it is also possible to provide, in place of the valve 9, connecting the pump 10 to the conduit 5, a more sensitive or variable type of control.

Moreover, in place of a single auxiliary pump 10, several such auxiliary pumps can be arranged which are connected and/or disconnected in sequence or series depending upon the magnitude of a control signal.

The pumping system for supplying the hydraulic motor 4 or the drive of the screw 3 includes a primary pump 11 and an auxiliary pump 10 driven by the same drive motor 1 which causes the rotation of the shell 2. However, such a central drive motor is not absolutely necessary.

In the left-hand portion of the drawing, a schematic supply arrangement for supplying material to be separated from the centrifuge is illustrated which supply arrangement includes a feed pump 12 driven by a motor 13. In the illustrated embodiment, although the control circuit is not influenced by the material input side, it is possible to employ this as a criterion for shutting off the centrifuge system. More importantly, it is to be noted that any change in the quantity and/or consistency of the material fed to the centrifuge will influence the regulating quantity or ideal value.

Safety arrangements are provided in the form of pressure sensors generally designated by the reference numerals 14, 15 shown in the right-hand portion of the drawing. Pressure sensor 14 is activated upon the exceeding of a prescribed pressure. Upon detection by the pressure sensor 14 that a prescribed pressure has been exceeded, a signal is coupled to a switch generally designated by the reference numeral 16 to interrupt the supply of material to be separated in the centrifuge by interrupting the power supply to the motor 13.

Pressure sensor 15 serves as a safety switch used, for example, when the screw 3 is suddenly blocked with respect to the shell 2 which, in turn, results in a corresponding sudden pressure increase in the conduit 5. In this case, the output of the pressure sensor 15, being coupled to a switch generally designated by the reference numeral 17, deactivates the drive motor 1 and brings the rotation of the shell 2 to a halt. A further safety pressure limiting or pressure relief valve 18 is coupled to the conduit 5. Upon exceeding a predetermined pressure in the pressure relief valve 18, the pressure medium returns to the pressure medium supply or collecting tank S.

The drive motor 1 operates an additional pump 19 which is controllable in the same manner as the pump 11. The pump 19 draws pressure medium through a conduit 19' from a further collecting and supply tank S' and supplies the pressure medium through a conduit 19" a filter 20 to a further hydraulic motor 21 having a mechanical output or drive section for driving the shell 2 by way of a V belt and pulley drive generally designated by the reference character V.

To control the speed of the hydraulic motor 21, it is possible, for example, to adjust the pump 19 with respect to the amount of pressure medium to be conveyed from the supply and collecting tank S' to the pump 19 and the motor 21. A throttling means (not shown) may also be inserted in the conduit between the pump 19 and the hydraulic motor 21.

Assuming that an actual value to be adjusted is determined by scanning the pressure in the supply conduit 5 for the hydraulic motor 4 of the screw 3 in a manner similar to the scanning by the actual-desired value comparator valve 8, it is possible, by providing a multi-channel valve such as the valve 9 for the auxiliary pump 10, to influence the amount of pressure medium conveyed by the pump 19 by adjusting the throttling means or the like arranged in the conduit between the pump 19 and the hydraulic motor 21.

It would also be possible to insert a throttle means for affecting the speed of the hydraulic motor 21 for the shell 2 in a return line 21' for the motor 21 to supply and collecting tank S'.

By virtue of the adjustability of the pump 19, the supply of the pressure medium thereto may be prevented, for example, by throttling and, consequently, in such a situation, no pressure medium would be supplied from the pump 19 to the hydraulic motor 21. When this occurs, the shell 2 drives the hydraulic motor 21 due to the inertia, i.e. the rotational kinetic energy inherent in the centrifuge causing the hydraulic motor 21 to operate as a pump.

A throttle means and/or switching device 22 is arranged in the return line 21' between the hydraulic motor 21 and a pressure medium supply and collecting tank S' thereby making it impossible for the hydraulic motor 21, in its pumping function, to operate against a resistance caused by the throttle means and/or switching device 22. To provide a control over the pumping effect of the hydraulic motor 21, the resistance of the throttle means and/or switching device 22 may be adjustable.

The throttle means and/or switching device 22 may be an electrical valve arrangement which includes a piston which is spring loaded. In such an arrangement with power being supplied to the electrical valve, the piston would assume a position illustrated in the drawing wherein the return line from the hydraulic motor 21 provides a return communication to the supply and collecting tank S' for the pressure medium fed to the hydraulic motor by the pump 19. Upon interrupting the power supply to the electrical valve the spring would bias the piston to a position blocking the return flow of pressure medium to the collecting tank.

With the hydraulic motor 21 being driven by the shell 2 and functioning as a pump operating against a resistance caused by the throttle means and/or switching device 22, it is possible for the hydraulic motor 21 to exert a braking torque on the shell 2 whereby a rapid control of the shell speed, insofar as it is intended, is greatly enhanced. Additionally, such a braking action by the hydraulic motor 21 provides the advantage that the separating chamber of the centrifuge can be completely emptied when the centrifuge unit is shut down or the solid matter moving with the shell runs, when the shell is braked due to its mass moment of inertia, along the channels or threads of the conveyor screw 3 and passes, depending upon the direction of inclination of the shell 2, to the solid discharge end or to the other end of the shell 2 where the liquid discharge end is provided in a countercurrent flow centrifuge construction. Such residual emptying action is of considerable significance in situations wherein a suspension being processed includes substances which tend toward solidification, curing or the like when the centrifuge is at a standstill. As can be appreciated, any solidification in the centrifuge would result in an impairing or an elimination of any mobility between the shell 2 and the screw 3.

The utilization of the hydraulic motor 21 as a pump is significant for imparting an emergency braking operation of the shell 2 in the event that a failure of a pressure medium supplied to the hydraulic motor 4 due to any number of causes. Specifically, if the pressure medium supply for the hydraulic motor 4 fails, the lack of a supply of pressure medium may result in a destruction of the rotary transmission 6, especially if the shell 2 is permitted to freely rotate with the rotation gradually slowing down, that is, permitted to rotate without any positive braking action.

To insure that the rotary transmission 6 is lubricated as long as the shell is rotating, a check valve 23 is arranged in a conduit or line 21'' between the pump outlet of the hydraulic motor 21 and the conduit 5. The line 21'' communicates with the conduit 5 at a position between the primary pump 11 and the rotary transmission 6. By virtue of this arrangement, if the pressure in the conduit 5 fails, due to any number of causes, it is possible to supply a pressure medium to the conduit 5 by way of line 21'' and check valve 23 as soon as the return 21' between the output of the hydraulic motor 21 and supply and collecting tank S' is blocked by the throttling means and/or switching device 22.

The throttling means and/or switching device 22 can be controlled, for example, by a pressure monitoring device connected to the conduit 5, which pressure monitoring device may take the form of pressure sensors such as the sensors 14, 15.

To insure that the motor 21, when operating as a pump, can draw in a pressure medium, the pump 19 is bridged or bypassed by way of a line or conduit 24'' and check valve 24.

Furthermore, in order to insure a supply of pressure medium to the conduit 5 through check valve 23 from the hydraulic motor 21 when operating as a pump and to avoid a discharge of the supplied pressure medium due, for example, to a defective main pump 11 so that such pressure medium could not be employed for lubricating the rotary transmission 6, a further check valve 25 is arranged in the conduit 5 between the line 21'' and the outlet of the main pump 11. The control arrangement of the present invention operates as follows:

Upon a reduction in the differential speed between the screw 3 and the shell 2 due to an increase in mechanical load on the screw 3, the pressure rises in the conduit 5 thereby resulting in a further supply of pressure medium to the pressure conduit from the auxiliary pump 10.

Once the differential speed between the screw 3 and shell 2 has increased due to the additional supply of pressure medium, the pressure of the pressure medium in the conduit 5 increases accordingly. Upon this occurrence, the actual valve-desired value comparative valve 8 interrupts the control signal to the multi-channel valve 9 to return the valve 9 to the idling position illustrated in the drawing. Upon the interruption of the signal to the valve 9, the auxiliary pump 10 is deactivated thereby stopping the supply of pressure medium from the auxiliary pump to the pressure conduit 5.

If the increase in the differential speed is to be combined simultaneously with a reduction in the speed of the shell 2, an output signal from the actual value-desired value comparator valve 8 is fed to an adjusting means for the pump 19 to reduce the amount of pressure medium conveyed by the pump 19. This type of control operation would be employed for the treatment of substances which are difficult to settle, such as, for example, activated sludge, as well as for the treatment of suspensions with thermoplastic synthetic resins if, simultaneously, a change in the speed of the shell is to be provided for this purpose.

However, if suspensions are processed with solids exhibiting rheopexy, it is possible to lower, with a decreasing differential speed, simultaneously the speed of the shell 2. In this instance, the actual value-desired value comparator valve 8 provides a signal to an adjusting unit for the pump 11 as well as a signal to an adjusting unit for the pump 19 so as to reduce the conveying power of the screw 3. Moreover, the shell 2 may be braked by operating the hydraulic motor 21, driven by the shell 2, as a pump operating against a resistance in the manner described hereinabove.

A further control possibility is realized by utilizing the connection between the output of the hydraulic motor 21 and the pressure conduit 5 through the check valve 23 to increase the supply of pressure medium in the conduit 5 to the hydraulic motor 4 through the pump action of the hydraulic motor 21 during a braking of the shell 2. By virtue of this arrangement, the differential speed is increased with a reduced speed of the shell 2 by enhancing the power of the auxiliary pump 10. It is also possible in this last-mentioned instance to dispense with the auxiliary pump 10 in certain circumstances such as, for example, in the treatment of activated sludge suspensions.

Since all of the return conduits respectively terminate in a supply and collecting tank S or S', it is also possible to provide a closed circuit for the pressure medium of the centrifuge system.

While I have shown and described only one embodiment in accordance with the present invention, it is understood that the same is not limited thereto, but is susceptible of numerous changes and modifications as known to a person skilled in the art, and I therefore do not wish to be limited to the details shown and described herein but intend to cover all such changes and modifications as are encompassed by the scope of the appended claims.

I claim:

1. A solid-shell screw-conveyor centrifuge which includes a shell and a screw rotating at differential speeds, a drive means for driving one of the shell and screw and a hydraulic motor for driving the other of the shell and screw, and rotary transmission means for supplying a pressure medium to the hydraulic motor, characterized in that the drive means is a second hydraulic motor, which, in a first operating condition, drives one of the screw and the shell and, in a second operating condition, is driven by one of the shell and screw so as to function as a pump, said second hydraulic motor including a pump discharge means, means are provided for communicating said pump discharge means with a pressure medium supply conduit for the rotary transmission means and the first hydraulic motor, and in that control means are provided for controlling the communication between the pump discharge means and the pressure medium supply conduit.

2. A centrifuge according to claim 1, characterized in that said second hydraulic motor drives the shell.

3. A centrifuge according to claim 2, characterized in that said control means includes a valve means arranged in said communicating means.

4. A centrifuge according to claim 3, characterized in that said control means is a spring-loaded check valve.

5. A centrifuge according to claim 4, characterized in that means are provided for adjusting a pressure of the pressure medium in said communicating means acting upon said check valve.

6. A centrifuge according to claim 5, characterized in that a return conduit means is connected with said second hydraulic means for returning a pressure medium supplied to the second hydraulic motor to a collecting means, and in that said adjusting means selectively open and close said return conduit means in response to a predetermined operating condition of the centrifuge.

7. A centrifuge according to claim 6, characterized in that said adjusting means is a valve means.

8. A centrifuge according to claim 7, characterized in that said valve means is an electric valve means normally maintained in an open position.

9. A centrifuge according to claim 8, characterized in that means are provided for biasing said electric valve means to a closed position upon an interruption of a supply of power to said valve means.

10. A centrifuge according to claim 9, characterized in that at least one pump means is provided for supplying a pressure medium to the rotary transmission and the first hydraulic motor, and in that pressure responsive means are interposed between a discharge end of said pump means and the rotary transmission means for controlling a flow of a pressure medium from the second hydraulic motor.

11. A centrifuge according to claim 10, characterized in that said pressure responsive means is a check valve.

12. A centrifuge according to claim 11, characterized in that at least one pump means is provided for supplying a pressure medium to said second hydraulic motor, and means are provided for bypassing a supplying of the pressure medium to said second hydraulic motor during a predetermined operating condition of the centrifuge.

13. A centrifuge according to claim 12, characterized in that said bypass means includes a check valve means arranged in parallel with a supply conduit extending between the pump means and the second hydraulic motor.

14. A centrifuge according to claim 1, characterized in that a return conduit means is connected with said second hydraulic motor for returning a pressure medium supplied thereto to a collecting means, and means are provided for selectively opening and closing said return conduit means in response to a predetermined operating condition of the centrifuge.

15. A centrifuge according to claim 14, characterized in that said means for selectively opening and closing said return conduit means is an electric valve means normally maintained in an open position.

16. A centrifuge according to claim 15, characterized in that means are provided for biasing said electric valve means to a closed position upon an interruption of the supply of power to said valve means.

17. A centrifuge according to claim 1, characterized in that at least one pump means is provided for supplying a pressure medium to the rotary transmission and first hydraulic motor, and in that pressure responsive means are interposed between a discharge end of said pump means and the rotary transmission means for controlling a flow of a pressure medium from the second hydraulic motor.

18. A centrifuge according to claim 1, characterized in that at least one pump means is provided for supplying a pressure medium to said second hydraulic motor, and means are provided for bypassing the supplying of a pressure medium to said second hydraulic motor during a predetermined operating condition of the centrifuge.

* * * * *